United States Patent [19]

Gandy

[11] Patent Number: 4,542,605

[45] Date of Patent: Sep. 24, 1985

[54] SIGN

[75] Inventor: James Gandy, Mississauga, Canada

[73] Assignee: Signtech Inc., Mississauga, Canada

[21] Appl. No.: 540,219

[22] Filed: Oct. 11, 1983

Related U.S. Application Data

[63] Continuation-in-part of Ser. No. 279,179, Jun. 10, 1981, Pat. No. 4,452,000.

[51] Int. Cl.[4] ..... G09F 13/04

[52] U.S. Cl. ..... 40/574; 40/152; 40/156; 40/603

[58] Field of Search ..... 40/156, 152.2, 610, 40/574, 564

[56] References Cited

U.S. PATENT DOCUMENTS

| | | | |
|---|---|---|---|
| 4,317,302 | 3/1982 | Von De Linde | 40/156 |
| 4,430,819 | 2/1984 | Chandler | 40/156 |
| 4,441,269 | 4/1984 | Dahl | 40/156 |
| 4,452,000 | 6/1984 | Gandy | 40/156 |

*Primary Examiner*—Gene Mancene
*Assistant Examiner*—Wenceslao J. Contreras
*Attorney, Agent, or Firm*—Robert F. Delbridge; Arne I. Fors

[57] ABSTRACT

A sign has a rigid peripheral frame extending around an opening lying in a plane and a sheet of flexible sign material extending across the opening. The frame has a flange with a free end defining the periphery of the opening, the flange extending from the free end in a direction relative to the opening. The flexible sign sheet material has a peripheral edge portion extending over the free end of the flange from the plane of the opening and then extending from the flange free end in a rearwardly and inwardly direction relative to the opening. A series of separate tensioning devices are spaced around the frame rearwardly of the plane of the opening and inwardly of the periphery of the opening. Each tensioning device has a retainer for retaining the peripheral edge portion of the flexible sign material and an adjuster for adjusting the position of the retainer relatively to the frame to cause the peripheral edge portion of the flexible sign sheet material to be pulled rearwardly and inwardly from the free end of the flange to tension the flexible sign sheet material across the opening.

8 Claims, 7 Drawing Figures

Figure 3:
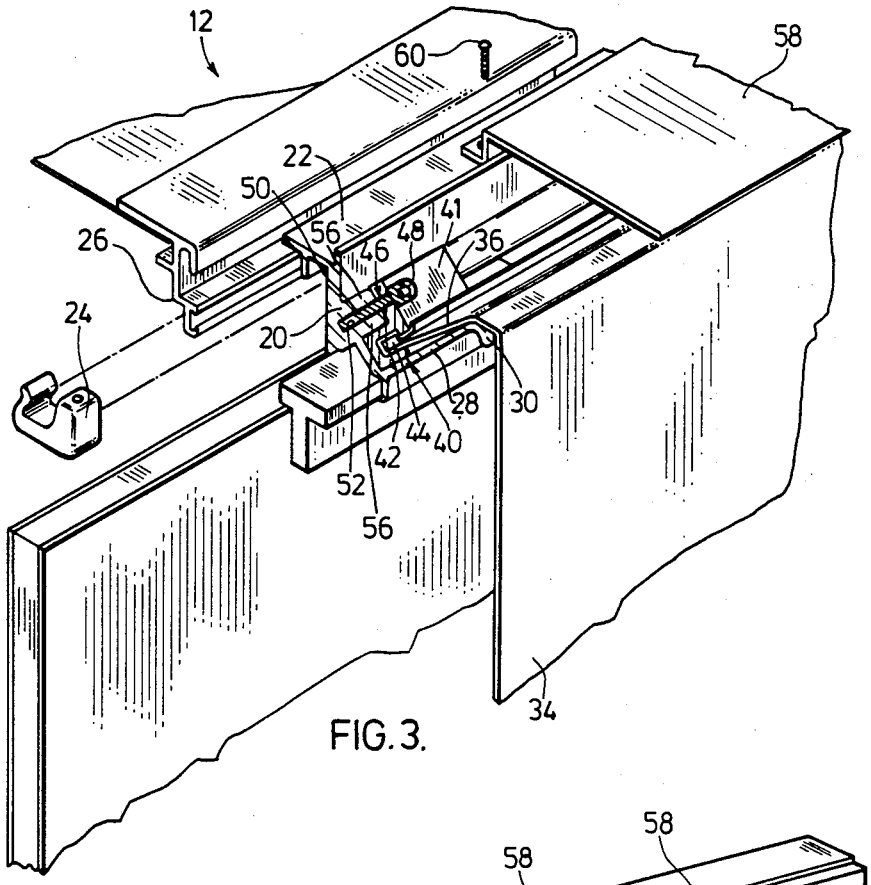

FIG.1.
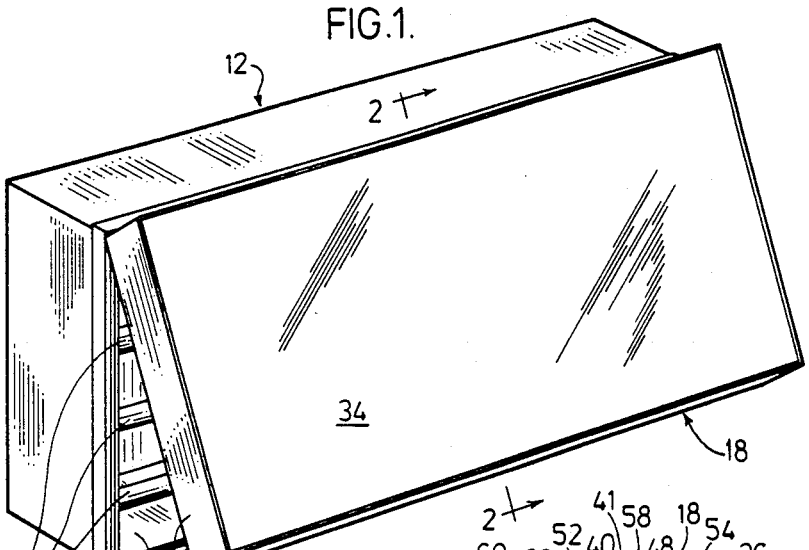
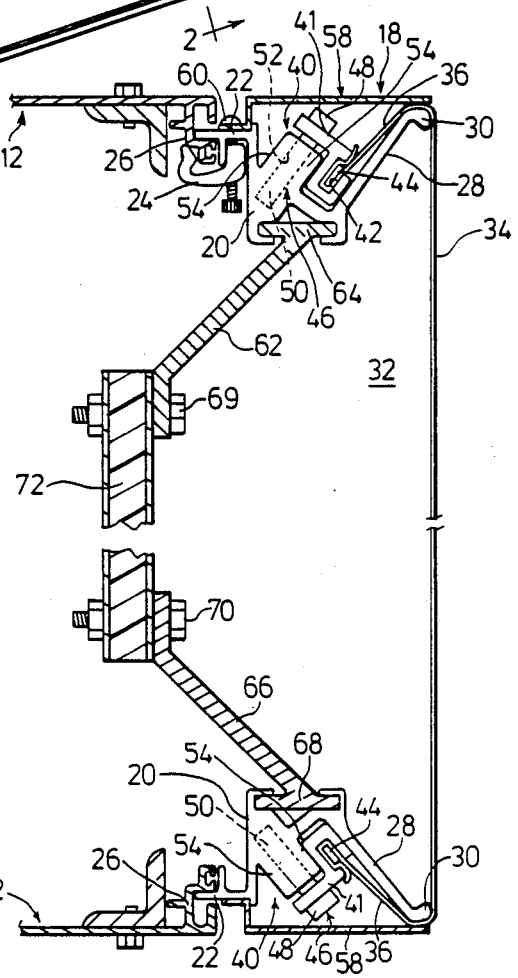
FIG. 2.

SIGN

This application is a continuation-in-part of application Ser. No. 279,179 filed June 10, 1981 now U.S. Pat. No. 4,452,000.

This invention relates to signs which have flexible sign sheet material secured in tension across the opening of a frame.

Such signs may be relatively large, and problems occur in the tensioning of the flexible sign sheet material across the opening of the frame, it being difficult to achieve a correctly tensioned sheet. In other words, it is difficult to tension the sheet in such a manner that it is wrinkle free and also such that it will withstand varying winds, temperatures and rain when the sign is outdoors and exposed to varying weather conditions.

Our earlier U.S. application Ser. No. 279,179, filed June 30, 1981 concerns the use of a series of sheet tensioning devices spaced around the frame rearwardly of the plane of the opening for tensioning the flexible sign sheet across the opening, each tensioning device comprising means for retaining the peripheral edge portion of the flexible sign sheet and an adjustable bolt having a head and threaded shank extending therefrom, the head abutting the retaining means and the shank extending through an aperture in the retaining means in a direction extending rearwardly of the plane of the opening into threaded engagement with the frame to enable the bolt head to be rotated to screw the shank into further threaded engagement with the frame with consequent rearward movement of the retaining means independently of the retaining means of the other sheet tensioning devices, while the retaining means is holding the edge portion of the flexible sign sheet, to cause the peripheral edge portion of the flexible sign sheet to be pulled rearwardly across the front edge thereby tensioning the flexible sign sheet across the opening.

The present invention provides an improved tensioning arrangement by providing the frame with a flange with a free end defining the periphery of the opening, said flange extending from the free end in a rearward and inward direction relative to the opening, the flexible sign sheet material having a peripheral edge portion extending over the free end of the flange from the plane of the opening and then extending from the flange free end in a rearwardly and inwardly direction relative to the opening, with there being a series of separate tensioning devices spaced around the frame rearwardly of the plane of the opening and inwardly of the periphery of the opening, each tensioning device comprises means for retaining the peripheral edge portion of the flexible sign sheet material and means for adjusting the position of the retaining means relatively to the frame to cause the peripheral edge portion of the flexible sign sheet material to be pulled rearwardly and inwardly from the free end of the flange to tension the flexible sign sheet material across the opening.

Thus, the tensioning devices lie within the periphery of the opening when the sign is viewed from the front, and thus the sign may be frameless in front view thereby giving the sign an enhanced appearance.

The adjusting means of each tensioning device may comprise an adjustable bolt having a head and a threaded shank extending therefrom, the head abutting the retaining means and the shank extending through the aperture in the retaining means in a direction extending rearwardly and inwardly of the periphery of the opening into threaded engagement with the frame to enable the bolt head to be rotated to screw the shank into further threaded engagement with the frame with consequent rearward and inward movement of the retaining means relative to the opening to tension the flexible sign sheet material across the opening. The bolt shank of each tensioning device may extend rearwardly and inwardly at an angle of about 45° to the plane of the opening.

The frame may have an elongated recess with opposed parallel side walls having ribs extending therealong, the ribs receiving the shank of an adjustable bolt of a sheet tensioning device in threaded engagement therewith at a preselected position along the length of the recess.

The frame may have opposed sides with at least one bracing means extending between the sides intermediate their ends and behind the flexible sign sheet material rearwardly of the plane of the opening to brace the frame against tension in the flexible sign sheet material. The bracing means may comprise first and second bracing members extending from respective opposite sides of the frame in directions inclined rearwardly from the plane of the opening, and a third bracing member extending in parallel spaced relationship to the flexible sign sheet material and secured to the first and second bracing members.

A sign assembly may comprise a longitudinally-extending housing and a plurality of signs as defined above secured to the housing in adjacent side-by-side relationship with the flexible sign sheet materials of the signs forming a substantially continuous sign surface. Alternatively, a sign assembly may comprise a housing having a pair of sides extending at angle to each other, and a pair of signs as defined above, each secured to a respective side, the housing also having a corner member at the junction of the sides, with the flexible sign sheet material of each sign substantially abutting the corner member.

Figure 4:
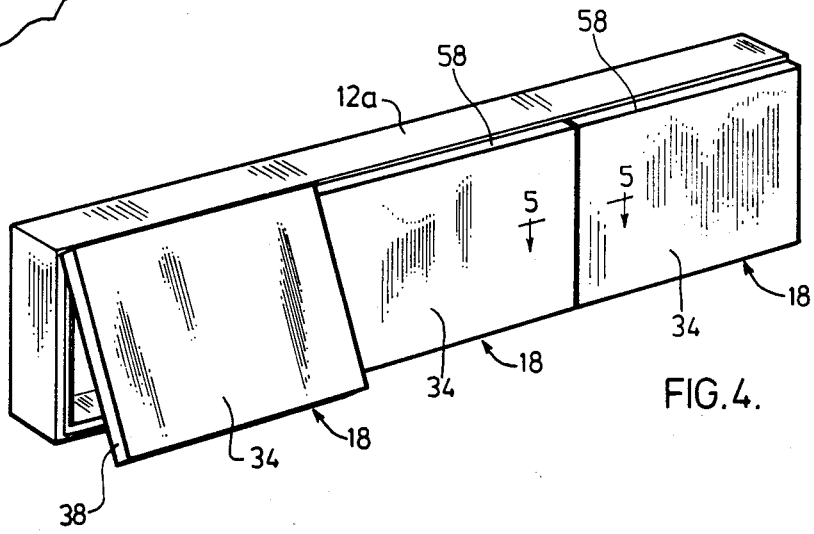
Figure 5:
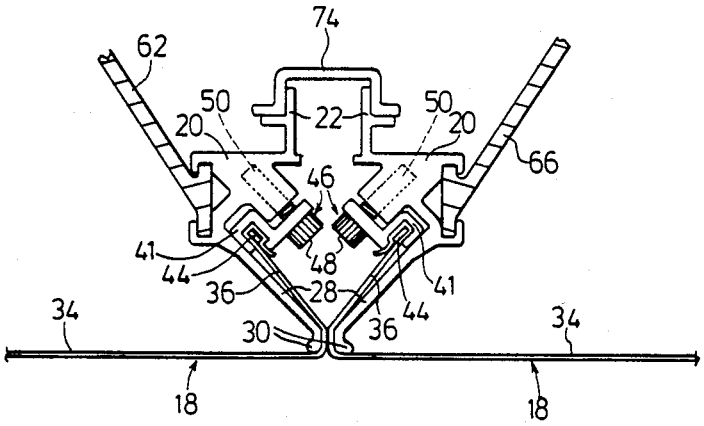
Figure 6:
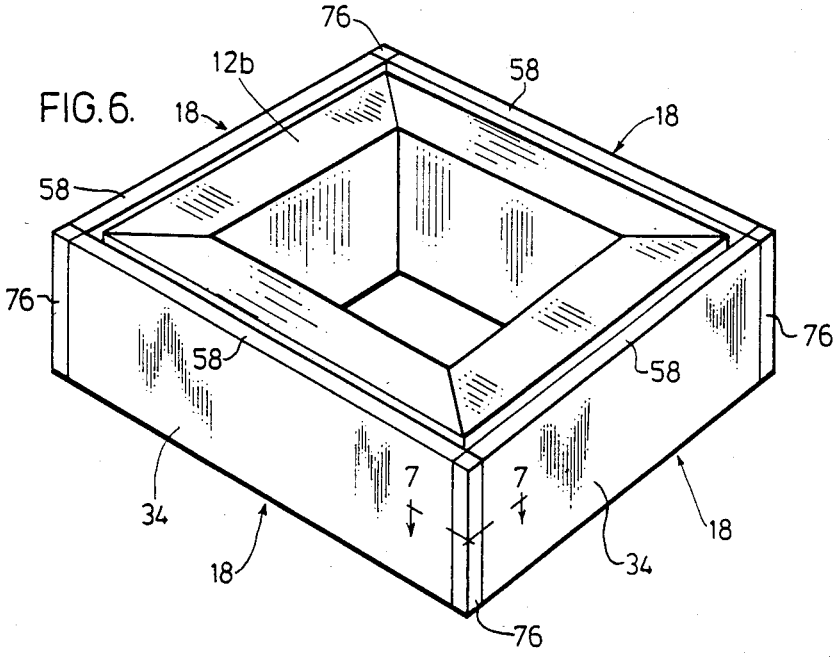
Figure 7:
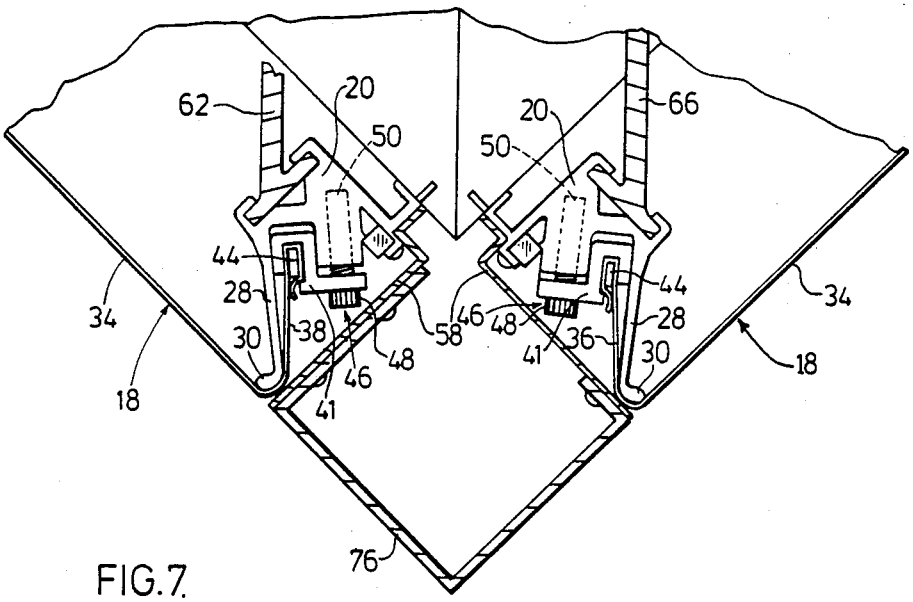

Embodiments of the invention will now be described, by way of example, with reference to the accompanying drawing, of which:

FIG. 1 is a perspective view of a sign assembly in accordance with one embodiment, FIG. 2 is a sectional view of the sign and adjacent portions of the housing taken along the line 2—2 of FIG. 1, FIG. 3 is a fragmental perspective view of the top of the sign and adjacent portions of the housing, FIG. 4 is a perspective view of a sign assembly in accordance with another embodiment, FIG. 5 is a sectional view of adjacent signs taken along the line 5—5 of FIG. 4, FIG. 6 is a perspective view of a sign assembly in accordance with a further embodiment, and FIG. 7 is a sectional view taken along the line 7—7 of FIG. 6.

Referring first to FIGS. 1 to 3, a sign assembly comprises a rectangular box-like housing 12 with an open front 14 and containing a series of fluorescent lamps 16 in known manner. A sign 18 in accordance with the invention extends over the open front 14 of the housing 12 and is hinged thereto at the top. The sign 18 has a rigid rectangular frame 20 with four extruded sides secured together by appropriate brackets (not shown) at the corners in a manner which will be readily apparent to a person skilled in the art. The rear of the frame 20 has a profile projection 22 which at the top is hinged by U-shaped hinge members 24 to a profile projection 26 at the front and top of the housing 12, such a hinged mounting being more fully described in our U.S. Pat. No. 4,380,880, issued Apr. 26, 1983.

The frame 20 has a flange 28 with a free end 30 defining the periphery of an opening 32, the flange 28 extending from its free end 30 in a rearward and inward direction relative to the opening 32. A flexible sheet of translucent sign material 34 extends across the opening 32 and has a peripheral edge portion 36 extending over the free end 30 of the flange 28 from the plane of the opening 32 and then extending from the flange free end 30 in a rearwardly and inwardly inclined direction relative to the opening 32.

A series of separation tensioning devices 40 are spaced around the sides of the frame 20 rearwardly of the plane of the opening 32 and also inwardly of the periphery of the opening 32. Each tensioning device 40 has means for retaining the peripheral edge portion 36 of the flexible sign sheet material in the form of a retainer member 41 having a recess 42 in which a retainer bar 44 is slidably retained. The peripheral edge portion 36 of the flexible sign sheet material is wrapped around the retainer bar 44 and thereby retained by the retainer member 41. Each tensioning device 40 has an individual retainer member 41 and retainer bar 44 so as to be independent of the other tensioning devices.

Each tensioning device 40 also has an adjustable bolt 46 having a head 48 and a threaded shank 50 extending therefrom. The bolt head 48 abuts the retainer member 41 and extends through an aperture therein in a direction extending rearwardly and inwardly of the periphery of the opening 32 into threaded engagement with the frame 20. For this purpose, the frame 20 has an elongated recess 52 with opposed parallel side walls 54 having ribs 56 extending therealong. The ribs 56 receive the shank 50 of the adjustable bolt 46 of each tensioning device 40 in threaded engagement, so that each tensioning device 40 can be positioned at any desired position along the sides of the frame 20.

Thus, to secure the flexible sign sheet material 34 to the frame 20, the peripheral edge portion 36 is wrapped around each retainer bar 44 in turn, and the retainer bar 44 is then slid into the recess 42 of the retainer member 41 of its tensioning device 40. The bolt 46 of the tensioning device 40 is then screwed into engagement with the ribs 56 in the frame recess 52 at an appropriate position along a side of the frame 20. After each tensioning device 40 has been attached to the peripheral edge portion 36 of the flexible sign sheet material 34 and has been secured to the frame 20 at an appropriate position, there then being tension devices 40 at spaced intervals along all four sides of the frame 20, the bolt 46 of each tensioning device 40 is screwed into the frame recess 52 to tension the sign sheet material 34 across the opening 32. Since each tensioning device 40 is independent of the others, the sign sheet material 34 can be tensioned in a wrinkle-free manner across the opening 32.

Also, because of the location of the tensioning devices 40 behind the frame flange 28, the tensioning devices 40 are within the periphery of the opening 32 when the sign is viewed from the front. In front view therefore, the sign is completely frameless, that is to say the sign material 34 extends to the periphery of the sign on all four sides. After the sign sheet material 34 has been tensioned, the tensioning devices 40 can be hidden from top, side and bottom view by four cover plates 58, one for each frame side, which each extends from the flange free end 30 rearwardly to the rear of the frame 20 and are secured to the profile projection 22 thereof by screws 60.

To reinforce the frame 20 against forces caused by the tension of the flexible sign sheet material 34, a series of spaced bracing means extend between opposed top and bottom sides of the frame 20. Each bracing means comprises a first bracing member 62 extending from the top side of the frame 20 in a direction inclined rearwardly from the plane of the opening 32, the first bracing member 62 having a profiled end 64 slidably engaged in a correspondingly profiled recess in the frame 20. A similar second bracing member 66 with profiled end 68 extends from the bottom frame side, with the inner ends of the first and second bracing members 62, 66 being bolted by bolts 69, 70 to opposite sides of a tubular third bracing member 72 which extends in parallel spaced relationship to the sign sheet material 34.

It has been found that such a bracing construction is advantageous in that it does not cause any significant shadow to be thrown onto the sign material 34 by the fluorescent lamps 16.

The embodiment shown in FIGS. 4 and 5 illustrate how a number of signs 18 in accordance with the invention can be mounted on an elongated housing **12*a* in adjacent side-by-side relationship with the flexible sign sheet material 34 of each adjacent pair of signs 18 forming a substantially continuous sign surface, thereby enabling a long sign of advantageous appearance to be provided. Adjacent sides of the frame 20 of adjacent sides 18 are aligned by a vertical channel-shaped member 74 extending vertically in the housing 12*a*, the channel-shaped member 74 receiving the profiled projections 22 of adjacent frames 20**.

FIGS. 6 and 7 show how four signs 18 in accordance with the invention can be mounted one on each side of the rectangular housing **12*b*, thereby providing a four-sided sign assembly of attractive appearance. The four corners may be completed by securing a corner post 76 to each adjacent pair of cover plates 58**.

Other embodiments of the invention will be readily apparent to a person skilled in the art, the scope of the invention being defined in the appended claims.

What I claim as new and desire to protect by Letters Patent of the United States is:

1. A sign comprising a rigid peripheral frame extending around an opening lying in a plane, a sheet of flexible sign material extending across the opening, said frame having a flange with a free end defining the periphery of the opening, said flange extending from the free end in a rearward and inward direction relative to the opening, the flexible sign sheet material having a peripheral edge portion extending over the free end of the flange from the plane of the opening and then extending from the flange free end in a rearwardly and inwardly direction relative to the opening, and a series of separate tensioning devices spaced around the frame rearwardly of the plane of the opening and inwardly of the periphery of the opening, each tensioning device comprising means for retaining the peripheral edge portion of the flexible sign material and means for adjusting the position of the retaining means relatively to the frame to cause the peripheral edge portion of the flexible sign sheet material to be pulled rearwardly and inwardly from the free end of the flange to tension the flexible sign sheet material across the opening.

2. A sign according to claim 1 wherein the adjusting means of each tensioning device comprises an adjustable bolt having a head and a threaded shank extending therefrom, said head abutting the retaining means and said shank extending through an aperture in the retaining means in a direction extending rearwardly and inwardly of the periphery of the opening into threaded engagement with the frame to enable the bolt head to be rotated to screw the shank into further threaded engagement with the frame with consequent rearward and inward movement of the retaining means relative to the opening to tension the flexible sign sheet material across the opening.

3. A sign according to claim 2 wherein the bolt shank of each tensioning device extends at an angle of about 45° to the plane of the opening.

4. A sign according to claim 1 wherein the frame has an elongated recess with opposed parallel side walls having ribs extending therealong, said ribs receiving the shank of an adjustable bolt of a sheet tensioning device in threaded engagement therewith at a preselected position along the length of the recess.

5. A sign according to claim 1 wherein the frame has opposed sides and at least one bracing means extending between said sides intermediate their ends and behind the flexible sign sheet material rearwardly of the plane of the opening to brace the frame against tension in the flexible sign sheet material.

6. A sign according to claim 5 wherein the bracing means comprises first and second bracing members extending from respective opposite sides of the frame in directions inclined rearwardly from the plane of the opening, and a third bracing member extending in parallel spaced relationship to the flexible sign sheet material and secured to the first and second bracing members.

7. A sign assembly comprising a longitudinally-extending housing and a plurality of signs in accordance with claim 1 secured to the housing in adjacent side-by-side relationship with the flexible sign sheet materials of the signs forming a substantially continuous sign surface.

8. A sign assembly comprising a housing having a pair of sides extending at an angle to each other, and a pair of signs in accordance with claim 1 each secured to a respective side, the housing also having a corner member at the junction of the sides, with the flexible sign sheet material of each sign substantially abutting the corner member.

* * * * *